US006071384A

United States Patent [19]

Schimion

[11] Patent Number: 6,071,384

[45] Date of Patent: Jun. 6, 2000

[54] ARRANGEMENT FOR THE ELECTROGALVANIC METAL COATING OF STRIPS

[75] Inventor: Werner Schimion, Hilchenbach, Germany

[73] Assignee: SMS Schloemann-Siemag Aktiengesellschaft, Düsseldorf, Germany

[21] Appl. No.: 09/065,317

[22] Filed: Apr. 23, 1998

[30] Foreign Application Priority Data

Apr. 25, 1997 [DE] Germany ..... 197 17 489

[51] Int. Cl.[7] ..... C25D 17/00

[52] U.S. Cl. ..... 204/206; 204/211

[58] Field of Search ..... 204/206, 211

[56] References Cited

U.S. PATENT DOCUMENTS 4,401,523 8/1983 Avellone ..... 204/206 X 5,582,708 12/1996 Delfrate et al. ..... 204/206 X

FOREIGN PATENT DOCUMENTS 0491163 6/1992 European Pat. Off. .

OTHER PUBLICATIONS

Chemical Abstracts, vol. 87, No. 26, Dec. 26, 1977, Abs. No. 208626 & JP 52 018649 A (Nippon Steel Corp., Japan).

*Primary Examiner*—Donald R. Valentine
*Attorney, Agent, or Firm*—Friedrich Kueffner

[57] ABSTRACT

An arrangement for the electrogalvanic metal coating of strips which travel through an acid electrolyte enriched with metal includes at least one insoluble anode arranged parallel to the strip, wherein the current flows to the strip switched as the cathode, and wherein metal is deposited from the electrolyte on the surface of the strip. Each anode is divided into anode strips parallel to the travel direction of the strip, wherein the anode strips are insulated relative to each other and each anode strip is individually supplied with current.

10 Claims, 4 Drawing Sheets

ARRANGEMENT FOR THE ELECTROGALVANIC METAL COATING OF STRIPS

BACKGROUND OF THE INVENTION

1. Field of the Invention

The present invention relates to an arrangement for the electrogalvanic metal coating of strips which travel through an acid electrolyte enriched with metal. The arrangement includes at least one insoluble anode arranged parallel to the strip, wherein the current flows to the strip switched as the cathode, and wherein metal is deposited from the electrolyte on the surface of the strip.

2. Description of the Related Art

Cold-rolled strip of normal carbon steel must be provided with a protective layer in order to prevent corrosion or at least significantly delay the corrosion. The type of protective layer depends on the intended use and the economical feasibility.

One method known in the art is galvanizing. When the strip is galvanized, the corrosion protection is achieved by a metal coating which is applied electrolytically.

Plants for applying such zinc layers on one side or both sides of the strip in thicknesses of about 2.5 to 15 micrometers are known in the art. The anodes are arranged parallel to the strip at as small a distance as possible of between 5 and 30 mm. The space between each anode and the strip is filled with an acid electrolyte which is enriched with metal, i.e., zinc. During coating, the current flows from the anodes to the strip which is switched as the cathode and the zinc is deposited on the surface of the strip.

In these conventional arrangements, there are problems when coating on one side as well as when coating on both sides. The current flux density increases toward the edges of the strip. Consequently, an extremely high current density occurs at the strip edges which leads to an increased depositing of zinc. Therefore, the thickness of the zinc layer in the edge region of the strip is about 2 to 3 times greater than in the middle of the strip.

Aside from the wasted metal and energy, this results in problems when coiling the strip and in the subsequent processing steps. For this reason, the edges of the strips must be trimmed over a great width prior to coiling which leads to a significant material loss as well as additional work.

If such an arrangement is to be used to coat the strip only on one side, there are additional problems. If the anode of the strip which is not be coated is completely removed or is replaced by a dummy anode, for example, a plastic plate, not only the edges of the side to be coated are galvanized, but because the current flows around the edge, the edges of the side not be coated are also galvanized.

If the anode on the side not be coated is merely electrically switched off, there is the additional problem that metal is deposited also on the strip side which is not to be coated. The reason for this is that current flows from the anodes which are wider as compared to the strip outside of the strip area through the electrolyte onto the switched-off anode and, thus, this anode is under voltage relative to the strip.

In order to solve these problems, so-called edge masks have become known. These masks are in the form of electrically insulating plates or foils and prevent the current from flowing between the two anodes next to the strip.

The strip edges engage in U-shaped sections arranged at the end faces of the electrically insulating plates. The degree of edge galvanization depends on the insertion depth of the strip edges into the U-shaped sections. Accordingly, it is necessary that the U-shaped sections always very exactly follow the strip travel. This requires a strip edge position measurement and complicated edge mask drives with complicated measuring and regulating technology.

Another disadvantage of the edge masks is the fact that they are susceptible to trouble. For example, when the strip edges are not smooth or when width variations of the strip occur suddenly, the edge masks may be damaged. Expensive idle times and repairs are the consequence.

Finally, the edge masks require a minimum distance between the anodes in order to be able to construct the edge masks with sufficient stability.

In addition, the edge masks do not solve the problem that the coating thickness over the width of the strip is a direct reflection of the transverse section of the strip. For example, if the strip has a transverse arc or other non-planarities or inclined positions between the anodes, this results in a non-uniform coating thickness. In order to prevent this undesired effect, the prior art provides for expensive stretching and straightening plants arranged upstream of the coating processes.

SUMMARY OF THE INVENTION

Therefore, starting from the above-described prior art, it is the object of the present invention to provide an arrangement for the electrogalvanic metal coating of the above-described type in which edge build-ups of the deposited metal are safely prevented and, simultaneously, the disadvantages of the arrangements with edge masks are avoided. In particular, a uniform metal coating is to be ensured independently of any possible non-planarities of the strip, a removal of the anode on a side not to be coated is to be rendered superfluous and no moveable parts should be required in the anode area.

In accordance with the present invention, in an arrangement of the above-described type, each anode is divided into anode strips parallel to the travel direction of the strip, wherein the anode strips are insulated relative to each other and each anode strip is individually supplied with current.

The arrangement according to the present invention makes it possible, in dependence on the respective width of the strip to be coated, to supply only those anode strips with current which are located opposite the strip. For this purpose, the actual strip position can be determined by means of the strip position measuring system which is already present.

The arrangement according to the present invention makes it especially also possible to coat non-planar strips in an advantageous manner by switching off the current supply of individual anode strips which are closer to the strip surface than intended in accordance with the average value of the distances.

Although the strip continues to be coated because of the dispersion effect of the adjacent anode strips, this takes place to a lesser extent. To an even lesser extent, this is also true for the strip which is next to the strip adjacent the anode strip. Consequently, switching-off of individual anode strips has the consequence that the coating becomes more uniform.

When the anode strips are insulated relative to each other by means of insulating materials arranged between the anode strips, and the insulating materials protrude at least above the surface of each anode facing the strip into the electrolyte, a current transfer from an anode strip supplied with current with an anode strip not supplied with current is effectively prevented. This also has an advantageous effect particularly in the strip edge areas because the current flux is directed toward the strip surface and high current density concentrations which are usual in the prior art are prevented.

If the anode strips are sufficiently narrow, it is possible by selecting a cover of the top or bottom of the strip edges with current-supplied anode strips to control the layer thickness, for example, such that the thickness decreases toward the strip edge, is uniform or increases toward the strip edge. If the anode strips are sufficiently narrow, the insulating strips protruding above the surface of each anode protect the anode against contact with the strip which may occur in the event of extremely nonplanar strips or when the tension in the strip decreases. Accordingly, this embodiment of the invention safely prevents strip contacts which occur in conventional arrangements under current and lead to high short circuit currents and to significant damage of the anode surface.

In order to eliminate this risk even more effectively, the insulating strips are preferably manufactured of wear-resistant and non-breakable material.

Another significant advantage of the insulating strips protruding above the surface of each anode is the fact that the electrolyte is guided parallel with or against the strip travel direction. The uniform flow speed adjusted over the strip width has the result of a more uniform metal deposition than in conventional arrangements in which transverse currents occur, particularly when the means for supplying and/or discharging the flowing electrolyte in the anode area are not constructed carefully.

In accordance with an advantageous further development of the invention, several anodes according to the invention are switched one behind the other in travel direction of the strip. Because the anodes switched one behind the other are individually controllable, the summation of the coating profile which is individually controllable for each anode makes it possible to ensure an always uniform coating thickness.

The coating profile can be controlled particularly effectively by supplying the anode strips with current by means of a current regulator. The current regulator keeps the desired current intensity constant in each anode strip. Since, in accordance with Coulomb's law, the galvanically deposited metal mass is directly proportional to the current sum, the coating thickness can be precisely controlled; for example, one gram zinc deposition requires 1.22 Ah.

Alternatively, the thickness of the coating can be controlled by dividing the anode strips of each anode several times over its length and by supplying each anode strip portion preferably through a switch individually with current. For example, if the anode strip is divided four times, each anode strip can be supplied with 0%, 25%, 50%, 75% and 100% current intensity.

Consequently, a percentage adequate layer build-up is produced on the strip in the area of this portion of the anode strip.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
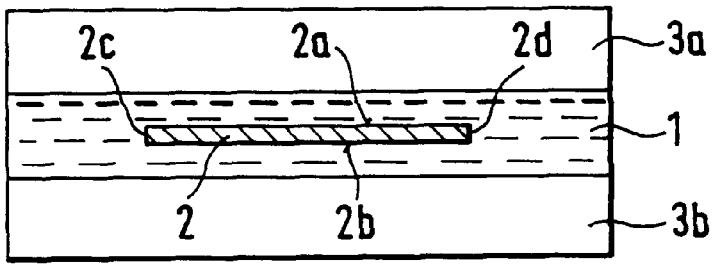
FIG. 1 PRIOR ART
FIG. 1 is a schematic illustration of an arrangement for the electrogalvanic coating of strips according to the prior art without edge masks.

FIG. 1 of the drawing shows the arrangement of the electrogalvanic coating of a strip 2 travelling in an electrolyte 1. Arranged parallel to the surfaces 2*a*, 2*b* of the strip 2 are at a small distance an upper and a lower anode 3*a*, 3*b*. The width of the upper and lower anodes 3*a*, 3*b* depends on the widest strip to be coated. If the strip to be coated has a width of, for example, 1,850 mm, the anode width may be 2,050 mm.

During metal coating, current flows from the anodes 3*a*, 3*b* to the strip 2 which is switched as cathode. The zinc from the electrolyte 1 is deposited on the surface 2*a*, 2*b*.

Figure 2:
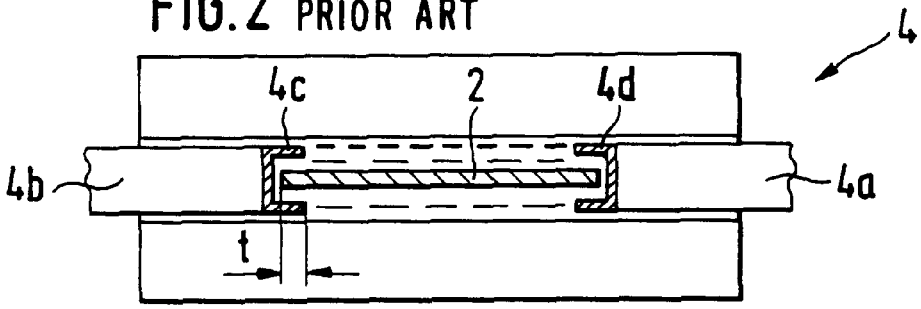
FIG. 2 PRIOR ART
FIG. 2 is a schematic illustration of an arrangement for the electrogalvanic coating of strips according to the prior art with edge masks.

In order to prevent a build-up of zinc at the edges 2*c*, 2*d* of the strip 2, it was proposed in accordance with the prior art to arrange so-called edge masks 4, as illustrated in FIG. 2. The edge masks are composed of insulating plates 4*a*, 4*b* and U-shaped sections 4*c*, 4*d* engaging over the strip edges 2*c*, 2*d*.

The degree of galvanization depends on the insertion depth t of the strip edges 2*c*, 2*d*. A drive for the edge mask 4, not shown in FIG. 2, moves the U-shaped sections 4*c*, 4*d* so as to precisely follow the extension of the strip edges 2*c*, 2*d*. This makes it necessary to provide complicated measuring and regulating means.

The arrangement of FIG. 1 as well as that of FIG. 2 have the disadvantage that the coating thickness over the width of the width of the strip is a direct reflection of the transverse section of the strip 2.

Figure 3:
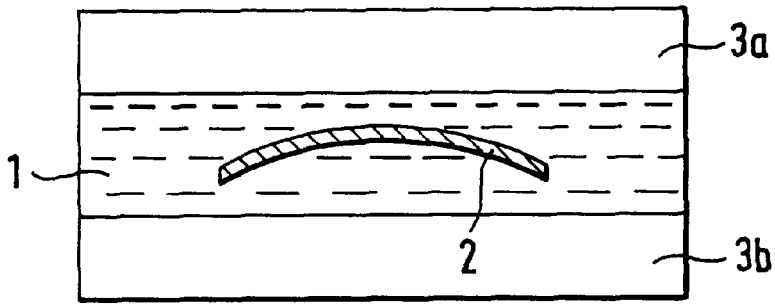
FIG. 3 is an illustration of the layer thickness in the case of non-planar strips, showing the example of a strip having a transverse arc.
Figure 3:
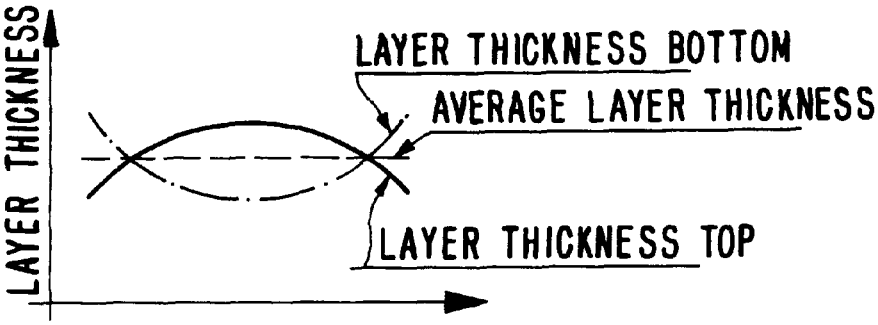

FIG. 3 shows this relationship in connection with the example of an arc-shaped cross-section of the strip 2 which is guided between an upper and a lower anode 3*a*, 3*b*.

Figure 4:
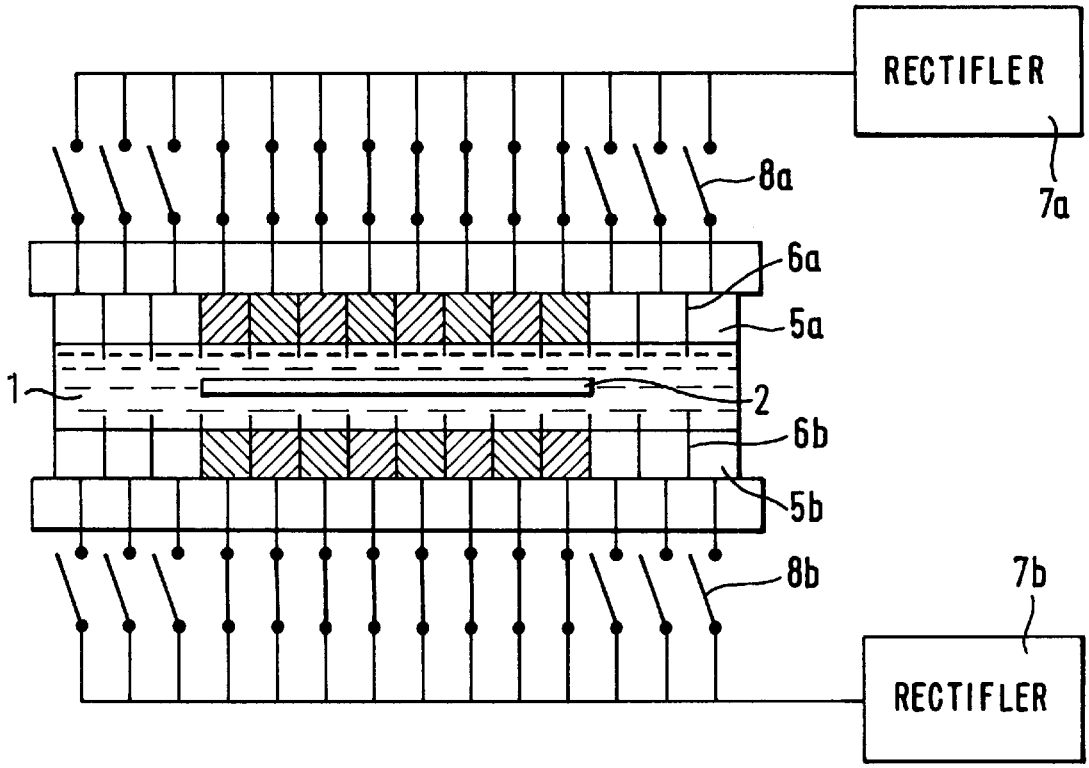
FIG. 4 is a schematic illustration of an embodiment of an arrangement for the electrogalvanic metal coating according to the present invention.
Figure 4:
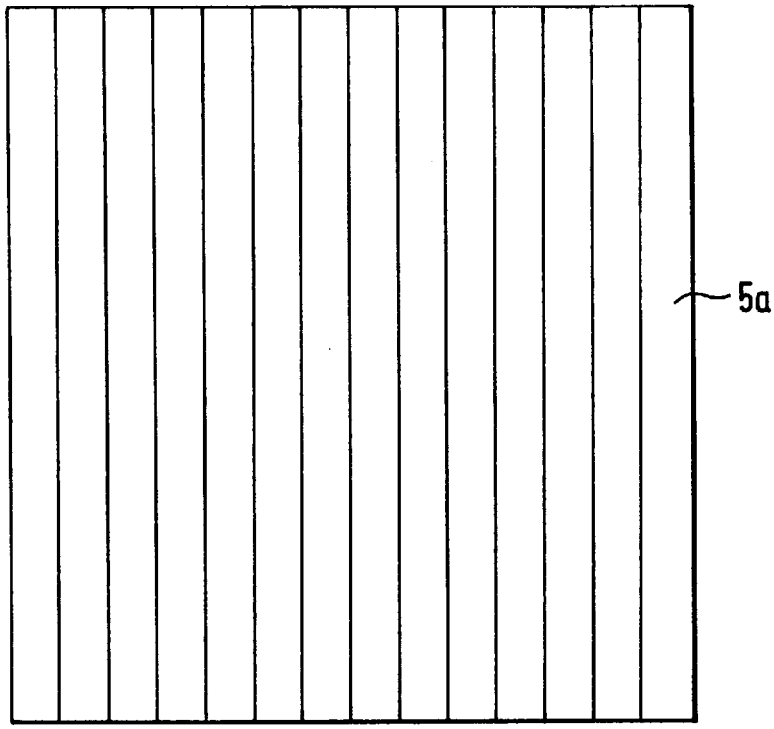

The arrangement according to the present invention shown in FIG. 4 is composed of individual anode strips 5*a*, 5*b* which, in the illustrated embodiment, are arranged above as well as below the strip 2. The individual anode strips 5*a*, 5*b* are insulated relative to each other by insulating strips 6*a*, 6*b* which protrude in the direction of the electrolyte 1 beyond the surface of the anode formed by the strips 5*a*, 5*b*.

The anode strips 5*a*, 5*b* form a lower and an upper box-shaped anode each, wherein the anodes, together with lateral covers not shown in FIG. 4, simultaneously form the flow channels for the electrolyte 1.

By constructing at least one of the lateral covers of the flow channel for the electrolyte 1 so as to be releasable, it is possible to exchange the entire arrangement very quickly for repair and/or maintenance work by laterally displacing the arrangement. Separate coating cells are not required in this embodiment.

In the illustrated embodiment, each individual anode strip 5*a*, 5*b* is connected through a separate switch 8*a*, 8*b* to a central rectifier 7*a*, 7*b* which supplies the switch with current.

FIG. 4 shows that only those switches 8*a*, 8*b* are closed which are provided for anode strips 5*a*, 5*b* which are located opposite the surface 2*a*, 2*b* of the strip 2.

Instead of providing the central rectifier 7*a*, 7*b*, it is also possible to provide for each individual anode strip a separate rectifier which is connected either through a switch or a current regulator to the anode strip.

The insulating strips 6*a*, 6*b* which protrude only by a few millimeters into the electrolyte 1 prevent a contact with the strip 2.

Figure 5:
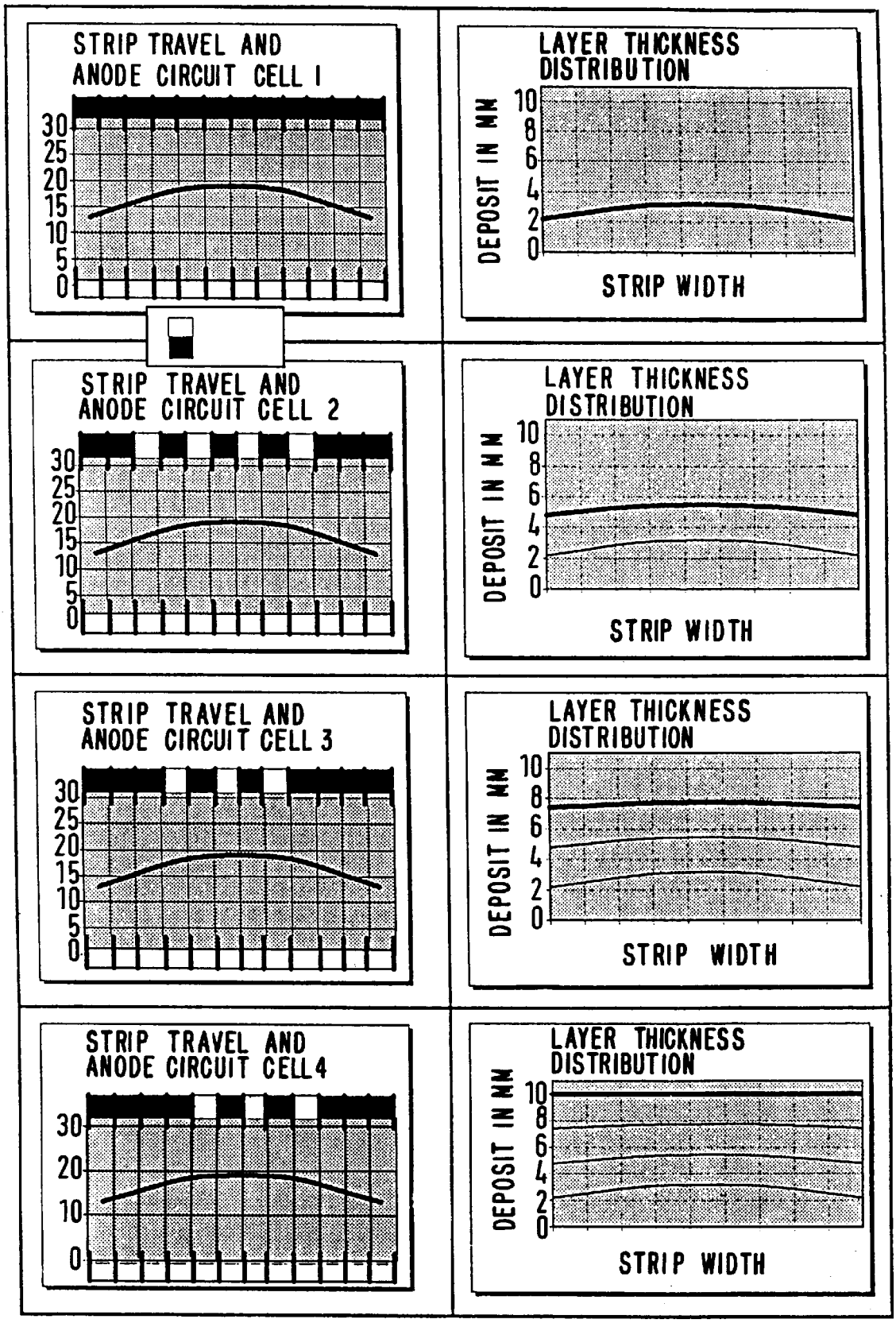
FIG. 5 is an illustration of the layer thickness control by means of an arrangement according to the present invention with four successively switched anodes in the case of coating on one side.

The illustration of FIG. 5 assumes that four anodes constructed in accordance with the invention and as illustrate d in FIG. 4 are arranged one behind the other in strip travel direction. In this embodiment, only the surface 2*a* of the strip 2 is coated. The anode strips 5*b* of the lower anode are all switched off.

The left hand side of FIG. 5 shows how the individual anode strips sa are switched; in the respective diagram to the right, the thickness of the zinc layer forming over the width of the strip 2 on the surface 2*a* thereof is illustrated.

It can be clearly seen that the build-up is uniform as a result of the summation of the layer thicknesses applied by the successive anodes.

Figure 6:
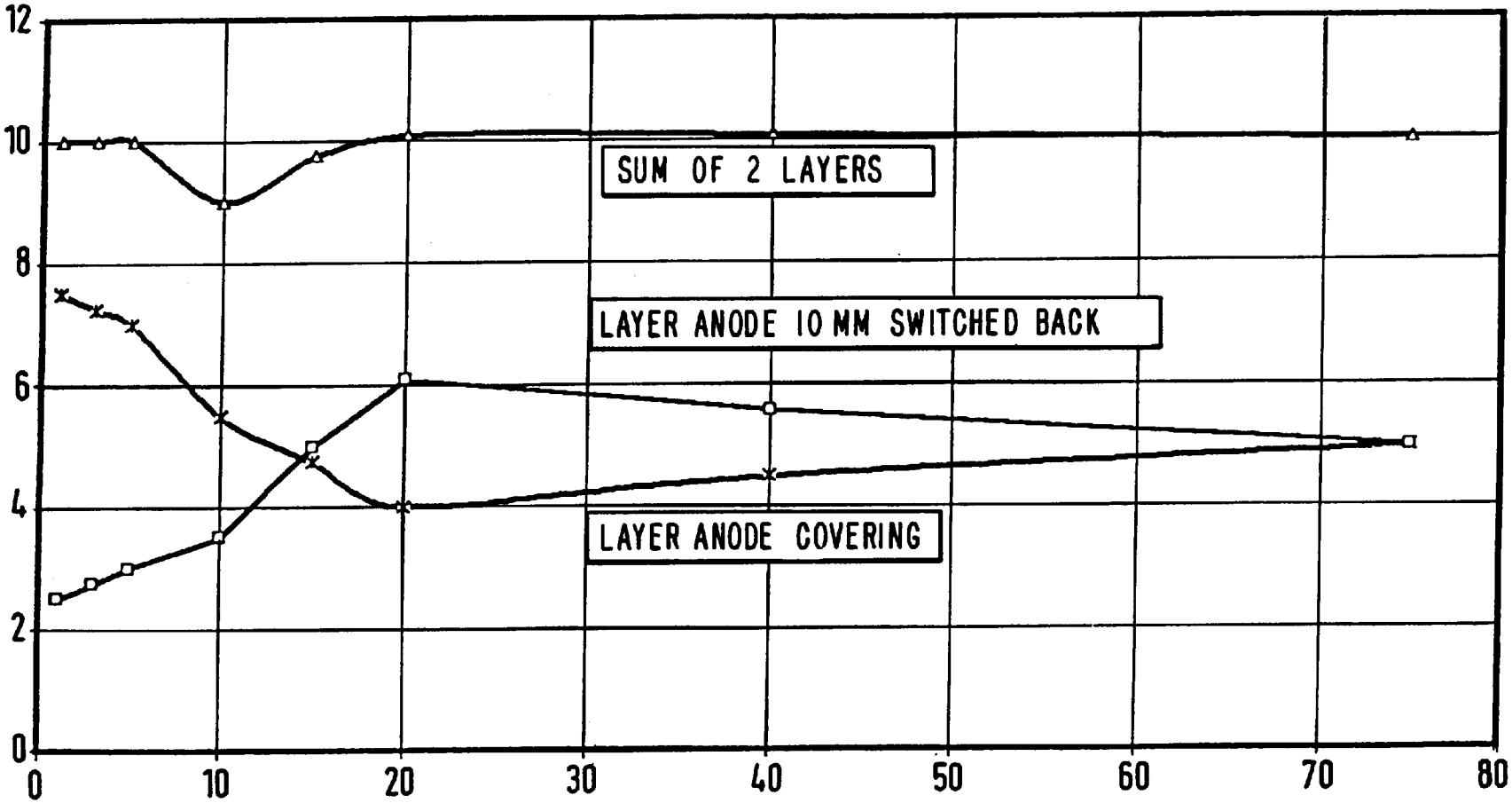
FIG. 6 is a diagram showing the layer thickness compensation in the edge area of the strip.

Finally, FIG. 6 shows a smoothing of the zinc layer in the edge area when travelling through only 2 successively switched anodes with different anode strips 5*a*, 5*b* being switched in the edge area of the strip 2.

While specific embodiments of the invention have been shown and described in detail to illustrate the inventive principles, it will be understood that the invention may be embodied otherwise without departing from such principles.

I claim:

1. An arrangement for electrogalvanically metal coating of strip, comprising means for moving the strip through an acid electrolyte enriched with metal, at least one insoluble anode arranged parallel to the strip, wherein current is adapted to flows from the anode to the strip when switched as a cathode, and wherein said metal is adapted for deposition from the electrolyte onto a surface of the strip, wherein each anode is arranged to be divided parallel to a travel direction of the strip into anode strips, the anode strips are insulated relative to each other, and each anode strip is individually supplied with current.

2. The arrangement according to claim 1, wherein the anode is adapted to have a greater width than any strip to be coated in the arrangement.

3. The arrangement according to claim 1, comprising insulating materials arranged between the anode strips for insulating the anode strips relative to each other, wherein the insulating materials protrude into the electrolyte at least above the surface of each anode when facing the strip.

4. The arrangement according to claim 3, wherein the insulating materials are wear-resistant and non-breakable strips.

5. The arrangement according to claim 1, wherein the anode strips have a width of between 50 and 40 mm.

6. The arrangement according to claim 1, comprising a plurality of anodes switched one behind the other in the travel direction of the strip.

7. The arrangement according to claim 1, wherein each anode strip is individually supplied with current by a switch.

8. The arrangement according to claim 1, wherein each anode strip is individually supplied with current by a current regulator.

9. The arrangement according to claim 1, wherein the anode strips of each anode are divided several times over a length thereof into anode strip portions, wherein each anode strip portion is supplied individually with current.

10. The arrangement according to claim 9, wherein each anode strip portion is supplied with current through a switch.

* * * * *